US005709161A

United States Patent [19]

Zanellati et al.

[11] Patent Number: 5,709,161

[45] Date of Patent: Jan. 20, 1998

[54] SEWING MACHINE FOR SEWING OVERLAPPING MATERIALS AND MAKING ORNAMENTAL SEAMS ON A SURFACE OF A SINGLE MATERIAL

[75] Inventors: Antonella Zanellati; Giovanna Squillaci, both of Vigevano, Italy

[73] Assignee: Falan S.r.l., Vigevano, Italy

[21] Appl. No.: 658,621

[22] Filed: Jun. 5, 1996

[30] Foreign Application Priority Data

Jun. 5, 1995 [IT] Italy ..... MI95A1164

[51] Int. Cl.[6] ..... D05B 85/00; D05B 47/04

[52] U.S. Cl. ..... 112/116; 112/302

[58] Field of Search ..... 112/302, 116, 112/163, 80.4, 470.26, 45.18, 439; 66/85 R

[56] References Cited

U.S. PATENT DOCUMENTS 1,291,526 1/1919 Hughes, Jr. ..... 112/116
2,506,432 5/1950 Philip ..... 112/116
3,428,007 2/1969 Wignall et al. ..... 66/85 R X
3,875,878 4/1975 Kaminski ..... 112/116

*Primary Examiner*—Ismael Izaguirre
*Attorney, Agent, or Firm*—Bucknam and Archer

[57] ABSTRACT

An improved sewing machine, for sewing overlapping materials and making ornamental seams on a single material comprises: a first supplying assembly for supplying a first seaming yarn, arranged under the pieces to be seamed, a second supplying assembly for supplying a second seaming yarn, arranged above the pieces to be seamed, a needle arranged on the top of the seaming region and a needle driving device for driving the needle by a reciprocating movement along a movement axis thereof in order to cause the needle tip to pass through the pieces to be seamed and to engage the first yarn so as to provide a yarn loop traversed by the second yarn, as a seaming stitch is formed. The machine has the main feature that it further comprises a loading device for automatically loading the second yarn, inside a "crochet" of the assembly supplying the second yarn, as well as a cutting device for cutting the second yarn at the end of the second yarn loading operation.

9 Claims, 6 Drawing Sheets

SEWING MACHINE FOR SEWING OVERLAPPING MATERIALS AND MAKING ORNAMENTAL SEAMS ON A SURFACE OF A SINGLE MATERIAL

BACKGROUND OF THE INVENTION

The present invention relates to an improved sewing machine for sewing overlapping materials and making ornamental seams on a surface of a single material.

As is known, two-yarn sewing machines are conventionally used which substantially comprise a supplying assembly for supplying a first seaming yarn, arranged under the pieces to be seamed, which are mutually overlapped, as well as a further supplying assembly for supplying a second seaming yarn, which is delivered above the pieces to be seamed.

These machines comprise a sewing or seaming needle which is arranged on the top of the seaming region, where are arranged the pieces to be seamed, and which is driven by a reciprocating movement along a movement axis thereof, so as to cause the tip of the needle to traverse the pieces to be seamed, and so as to engage the first yarn to bring it to the top of the pieces to be seamed.

Thus, a yarn loop is formed, which is engaged by a crochet and caused to pass about a spool on which is wound the second seaming yarn.

In conventional sewing machine of the above mentioned type, the thus formed seaming stitch is subjected to a tension, by stretching the first yarn by means of a suitable tensioning element.

At the end of the sewing or seaming operation, the pieces must be disengaged by manually cutting both the top yarn and the bottom yarn.

For each subsequent working cycle, the operator must remove from the crochet a sufficient amount of yarn to hold said yarn during the formation of the first seaming stitches.

During the operation of these machines, because of an exhaustion of the top yarn, it is disadvantageously necessary to replace the spool or reel by means of manual or semi-automatic devices, which, however, greatly reduce the operating speed.

SUMMARY OF THE INVENTION

Accordingly, the aim of the present invention is to overcome the above mentioned drawbacks, by providing a sewing machine allowing to automatically load the yarn directly into the crochet, thereby releasing the operator from the operation of cutting the top yarn, thereby fully exploiting the production capability of the sewing machine.

Within the scope of the above mentioned aim, a main object of the present invention is to provide such a sewing machine releasing the operator from the requirement of manually holding the yarn delivered from the crochet during the formation of the first seaming stitches.

Another object of the present invention is to provide such a sewing machine in which are efficiently eliminated all of the manual operations related to the top yarn and which conventionally must be performed in prior sewing machines.

Yet another object of the present invention is to provide such a sewing machine which is very reliable and safe in operation.

According to one aspect of the present invention, the above mentioned aim and objects, as well as yet other objects, which will become more apparent hereinafter, are achieved by an improved sewing machine, for sewing overlapping materials and making ornamental seams on a single material, comprising:

a first supplying assembly for supplying a first seaming yarn, under pieces to be seamed, a first supplying assembly for supplying a second seaming yarn above said pieces to be seamed, a seaming needle arranged above a seaming region, needle driving means for driving said needle by a reciprocating movement along a movement axis thereof, so as to cause a tip of said needle to pass through said pieces to be seamed and engage said first yarn so as to form a yarn loop traversed by said second yarn as a seaming stitch is formed, characterized in that said sewing machine comprises moreover automatic loading means for automatically loading said second yarn inside a crochet of said second yarn supplying assembly, and cutting means for cutting said second yarn as an operation of said loading means is ended.

BRIEF DESCRIPTION OF THE DRAWINGS

Further characteristics and advantages of the sewing machine according to the present invention will become more apparent hereinafter from the following detailed disclosure of a preferred, though not exclusive, embodiment of said sewing machine, which is illustrated, by way of a merely indicative, but not limitative example, in the figures of the accompanying drawings, where.

DESCRIPTION OF THE PREFERRED EMBODIMENTS

Figure 1A:
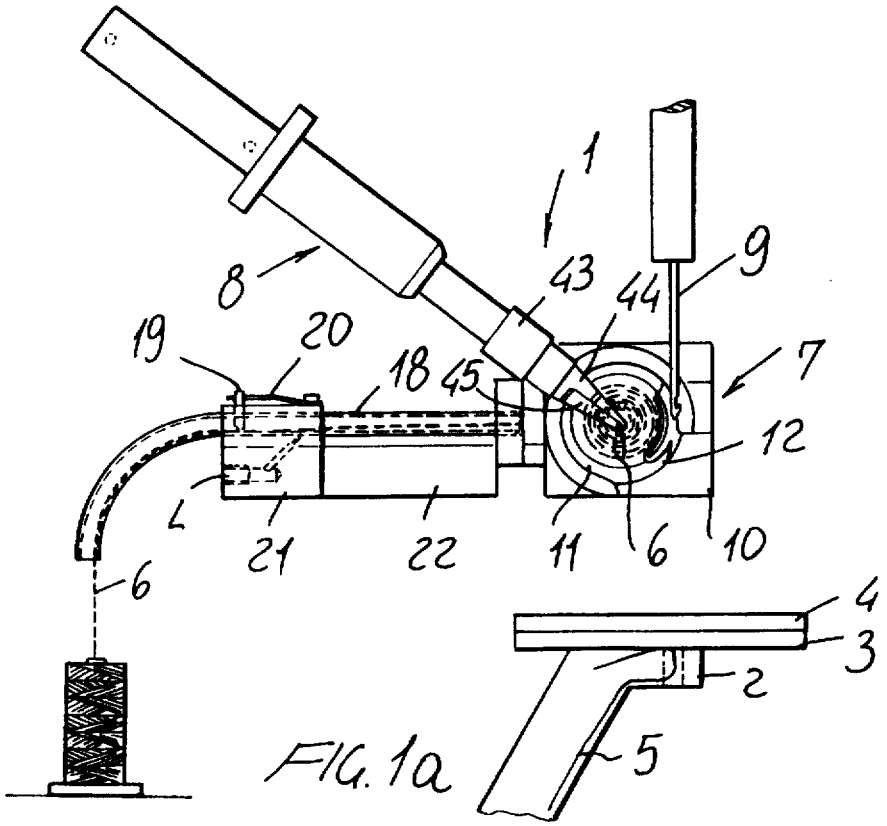
FIG. 1*a* is a schematic front elevation view illustrating the sewing machine according to the present invention in a ready condition for starting a seaming sequence.
Figure 1B:
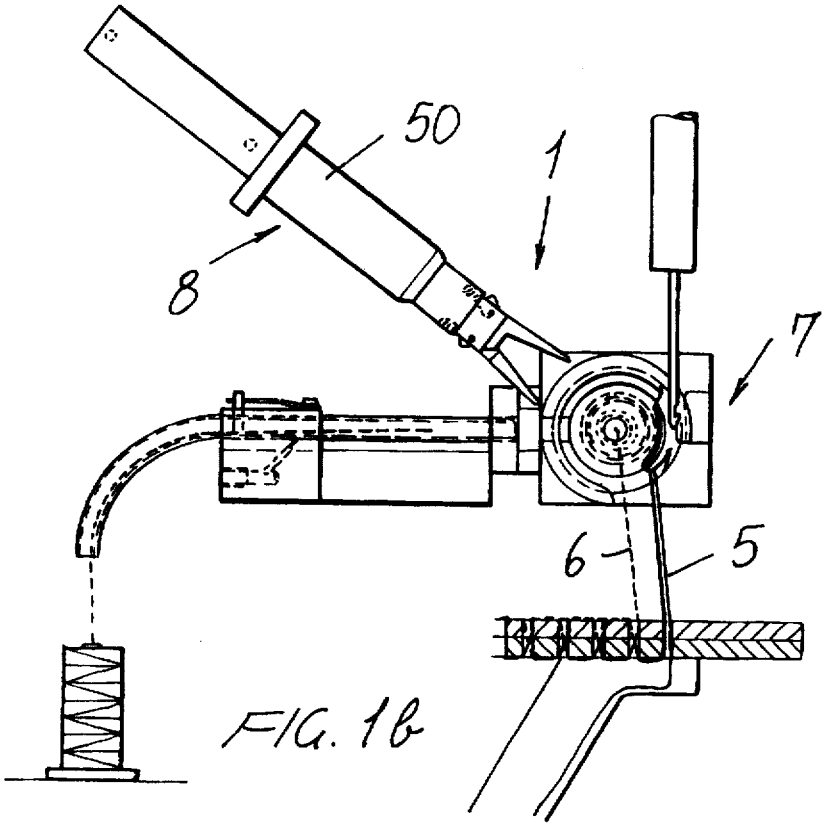
FIG. 1*b* is a further schematic front elevation view illustrating the sewing machine according to the present invention during the sewing or seaming process.
Figure 1C:
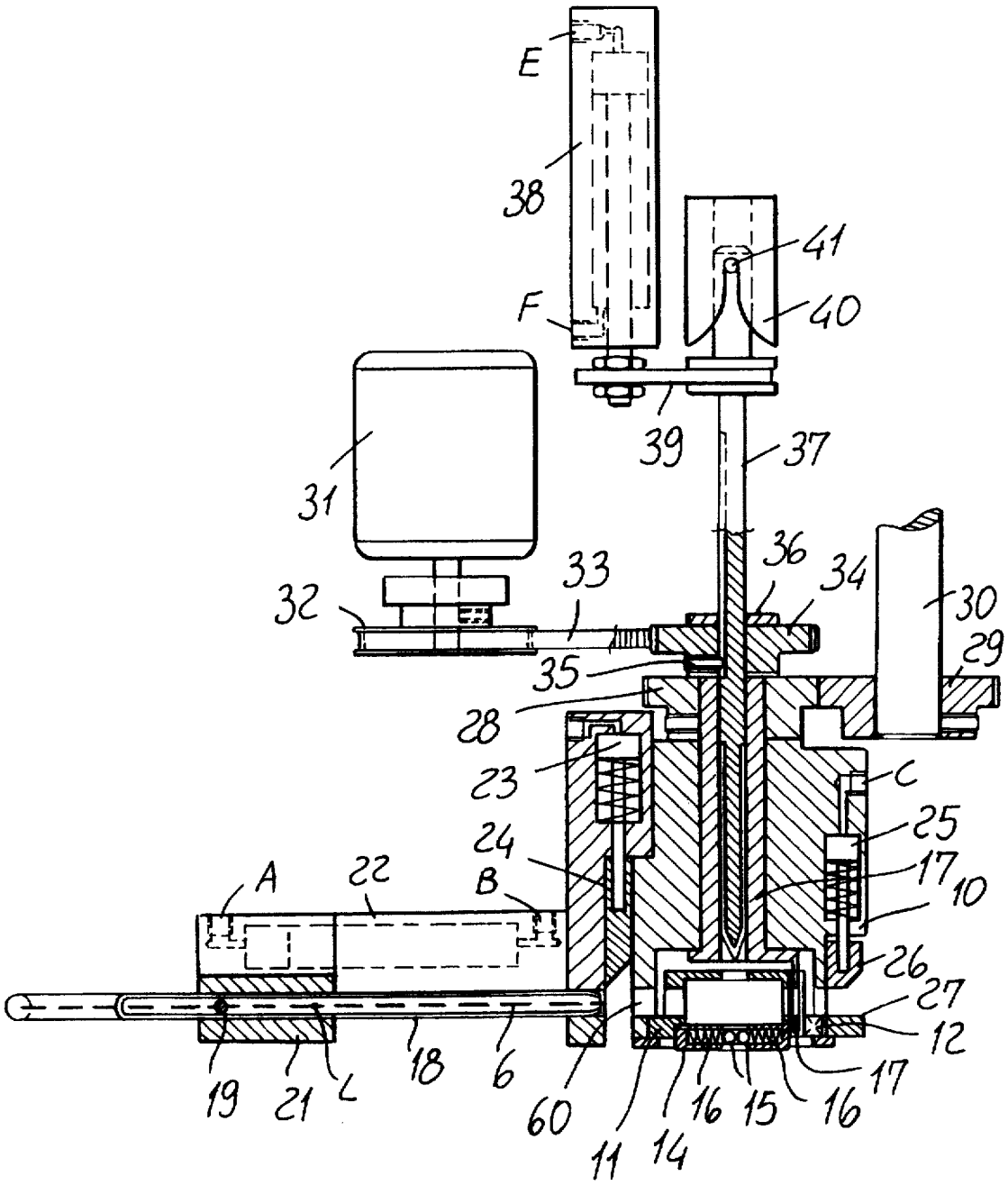
FIG. 1*c* illustrates the means for automatically loading the second yarn, the sewing machine being shown by a top plan view and as partially cross-sectioned.

With reference to the number references of the above mentioned figures, the sewing machine according to the present invention, which has been generally indicated by the reference number 1, comprises a bearing element 2, defining a support for the pieces 3 and 4 to be seamed, during the operation of the machine.

Under the bearing element 2 is provided a first yarn supplying assembly, of any known type and not shown for simplicity, for supplying a first seaming or sewing yarn 5, which has been represented by a continuous line, in order to distinguish it from a second seaming or sewing yarn 6, which has been shown by a dashed line, and which is supplied by a second yarn supplying assembly 7, arranged on the top of the pieces 3 and 4 to be seamed.

On the top of the bearing region, defined by said bearing element 2, is provided a seaming needle 9, which has the axis thereof arranged vertically and which can be driven, in a per se known manner, by a reciprocating movement along said axis, in order to cause the needle tip or point to sequentially pass through the region of the pieces 3 and 4 to be seamed, as mutually overlapped, which are arranged at the seaming region, i.e. at the bearing region defined by said bearing element 2, which is provided with a hole at the needle 9 to allow the needle to fully traverse the pieces 3 and 4 to be seamed and engage the first yarn 5 which is supplied at the top end portion of the bearing element 2.

The yarn supplying assembly for supplying the second yarn 6 comprises a crochet holding element 10 which rotatably supports, so as to rotate about a horizontal axis, a crochet 11, including a peak 12 by means of which said crochet, in its rotary movement, can engage the yarn loop formed by the traversing of said tip of said needle 9 through the pieces 3 and 4 to be seamed, and as said needle 9 is caused to raise again.

In the body of the crochet 11 a hollow 13 is formed, in which is engaged the second yarn 6, which is supplied through an opening defined through the frontally facing axial end portion of the crochet 11.

More specifically, the hollow 13 is closed at the front thereof by a small cover 14 which is provided, inside it, at the yarn 6 outlet opening or port, with gripping means for gripping the yarn, said gripping means comprising two tension elements 15 and two loading springs 16, which operate to hold the yarn 6 in a braked condition, as the stitch is formed.

The rotary movement of the crochet 11 is provided by a driving shaft 17 on which is keyed a driving gear 28 which is in turn driven by a driving gear 29, keyed on a shaft 30, in turn synchronously driven with all of the other elements of the sewing machine.

The sewing machine according to the present invention comprises moreover automatic loading means for automatically loading the second yarn 6, in the hollow 13 of the crochet 11, and means for cutting said second yarn 6 on ending the loading operation.

Furthermore, the subject sewing machine is also provided with gripping means 8 for gripping the second yarn 6 exiting the crochet 11 during the formation of the first seaming stitches.

More specifically, the automatic loading means for automatically loading the second yarn 6 comprise a yarn guiding tube 18, which is arranged on a side of the crochet 11 and which can be controllably inserted into a throughgoing hole 60 defined through the crochet holding element 10 and through said crochet 11, transversely of the axis of the latter.

In particular, the yarn guiding tube 18 can be controllably connected to pressurized air supplying means in order to hold said yarn 6 in a straight condition and to subject said yarn to a small pushing force in order to facilitate said yarn 6 in exiting the end of the yarn guiding tube 18 facing the crochet 11.

As shown, the yarn guiding tube 18 is mounted on a supporting element 21, affected by a double-action fluid-dynamic cylinder 22, the operation of which causes the yarn guiding tube 18 to be inserted into or withdrawn from the hollow 13 defined in the crochet 11.

On the supporting element 21 is moreover mounted a loading spring 20 operating on a yarn braking element 19 extending inside the yarn guiding tube 18.

The automatic loading means for automatically loading the second yarn 6 inside the crochet 11 also comprise gripping means for gripping the yarn supplied by the yarn guiding tube 18, which gripping means are arranged on the outlet side of the throughgoing hole 60.

More specifically, these gripping means comprise a fluid-dynamic cylinder 25, of the simple effect type, which is formed inside the crochet holding element 10, and which is connected, by the rod of its piston, extending parallely to the axis of the crochet, to a movable locking element 26 facing a biassing element 27 rigid with the crochet bearing element 10.

Furthermore, the automatic loading means for automatically loading the second yarn 6, inside the crochet 11, also comprise latching means for latching the yarn delivered from the yarn guiding tube 18 inside the hollow 13 formed in the crochet.

Said latching means for latching the yarn supplied by the yarn guiding tube 18 inside the hollow 13 comprise a loading shaft 37, which is arranged coaxially of the crochet 11 and which can be controllably engaged in the hollow 13 of said crochet by causing the loading shaft 37 to be displaced along the axis thereof in order to engage, by the end thereof entering the crochet 11, the yarn supplied by the yarn guiding tube 18 and to bring it outside of the opening controlled by the tensioning elements 15.

About the loading shaft 37, on the portion thereof projecting from the crochet holding element 10, at the opposite portion of the region where is arranged the crochet 11, is provided a toothed pulley 35 which is made rigid in its rotary movement with the loading shaft 37 by a dowel 35, said pulley being suitable to axially slide along said shaft 37.

In particular, said toothed pulley 34 is coupled, by means of a belt 33, to another toothed pulley 32 which is keyed on the output shaft of an auxiliary motor 31, which is controlled by an electronic driving element, for example a microprocessor which, as instructed by the operator, by rotatively operating the loading shaft 37 about the axis thereof, will cause a sufficient amount of yarn to be wound inside said hollow 13, so as to fit the seam to be performed.

More specifically, the loading shaft 37 can be engaged, by the tip thereof, which is so arranged as to engage the yarn supplied by the yarn guiding tube 18, into the hollow 13 of the crochet, by means of a fluid-dynamic cylinder 38 which, by the piston rod thereof, is connected to a connection plate 39 to the loading shaft 37.

The cutting means for cutting the yarn delivered by the yarn guiding tube 18 comprise a guillotine type of blade 24 which is arranged on a side of the crochet 11, i.e. on the portion thereof opposite to the movable locking element 26, and which is connected to the piston rod of the piston of a fluid-dynamic cylinder, of the simple effect type, 23, also formed in the crochet holder element 10 and having the axis thereof parallel to the axis of said crochet.

The supply assembly 7 comprises moreover a fixed guiding element 40 which will operate, owing to the specifically designed contour thereof, to properly orient about the axis thereof the loading shaft 37 on which is keyed a movable guiding element 41 which, as it engages with the fixed element 40, will cause the loading shaft to be returned to its ideal starting condition.

The gripping means 8 provided for supporting and holding the seaming yarn 6 as the first stitches are formed, comprise a fluid-dynamic cylinder 42 which, by the piston rod of the piston thereof, is coupled to a gripper holding movable element 43, supporting a top arm of the gripper 44 and a bottom arm of the gripper 45. The opening and closing movements of the two arms of the gripper are driven by a gripper closing piston 46.

The sewing machine according to the present invention operates as follows.

For performing seaming stitches it is necessary, as a first operation, to load into the hollow 13 of the crochet 11, the required amount of yarn 6.

This operation is performed by the sewing machine operator by means of an electronic driving or control element, based on the seaming requirements or automatically if said electronic control element has been preliminarily programmed.

In this case, the loading operation is performed in an automatic manner at the end of each seaming cycle.

Figure 2:
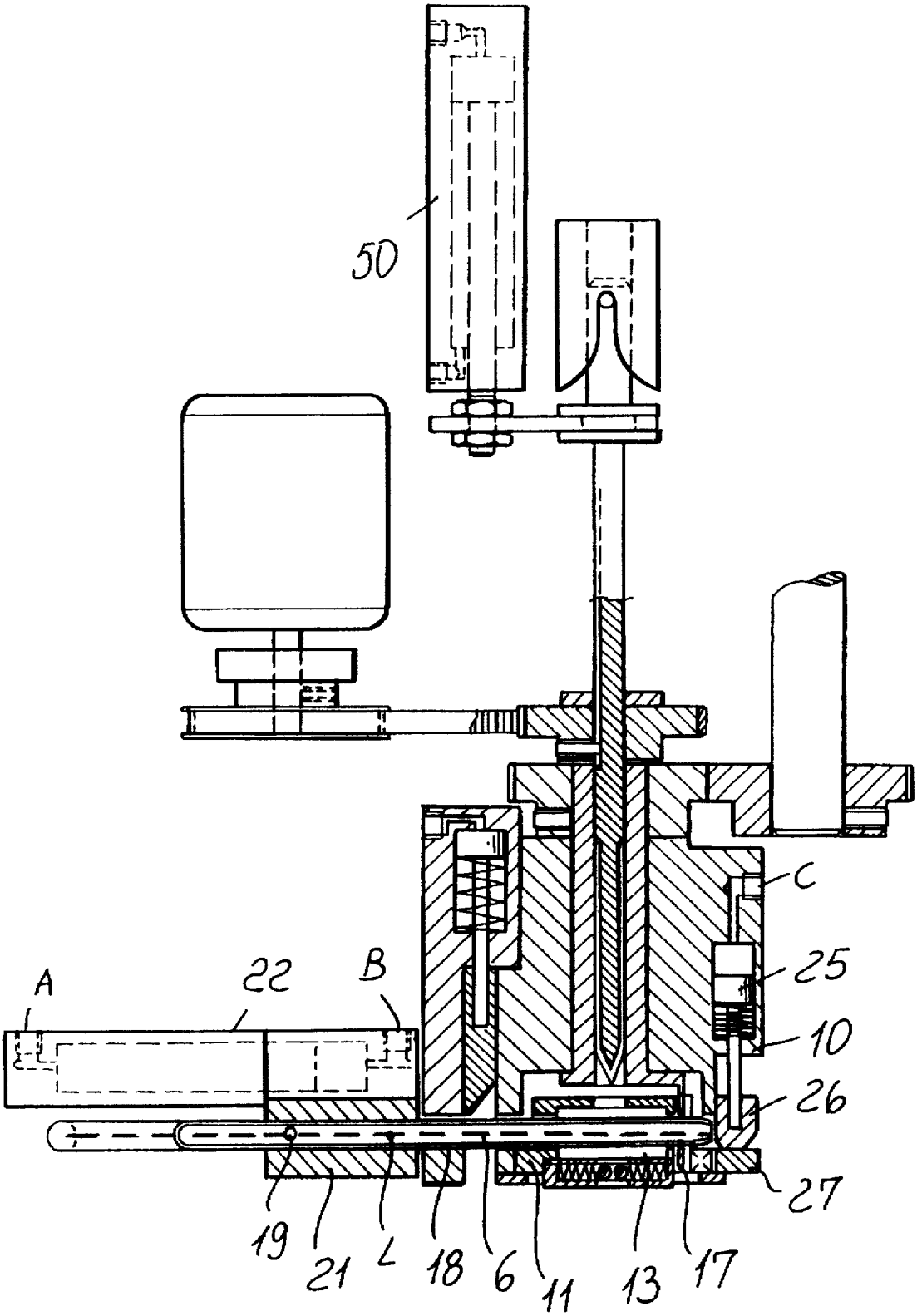
FIGS. 2 to 5 schematically illustrate the sewing machine according to the present invention, by a view like that of FIG. 1*c*, during the loading of the yarn into the crochet, the cutting of said yarn, after having loaded a sufficient amount of said yarn, and the gripping of the yarn for forming the first seaming stitches.

More specifically, this operation is performed, as shown in FIG. 2, according to a movement sequence which are automatically quickly carried out as follows.

Pressurized air is supplied through the duct A of the fluid-dynamic cylinder 22 so as to cause the support element 21 on which is arranged the yarn guiding tube 18 to be displaced, to traverse the crochet holder element 10, the crochet 11 and the driving shaft 17, by passing through the hole 60.

Simultaneously, pressurized air is supplied through the duct L of the yarn guiding tube 18, which operates to support the yarn and displace it by several millimeters so as to cause, by supplying pressurized air into the duct C, the piston of the cylinder 25 to be driven, on the rod of said piston being connected the movable locking element 26, which will lock the yarn 6 against the abutment element 27 fixedly arranged on the crochet holding element 10.

Figure 3:
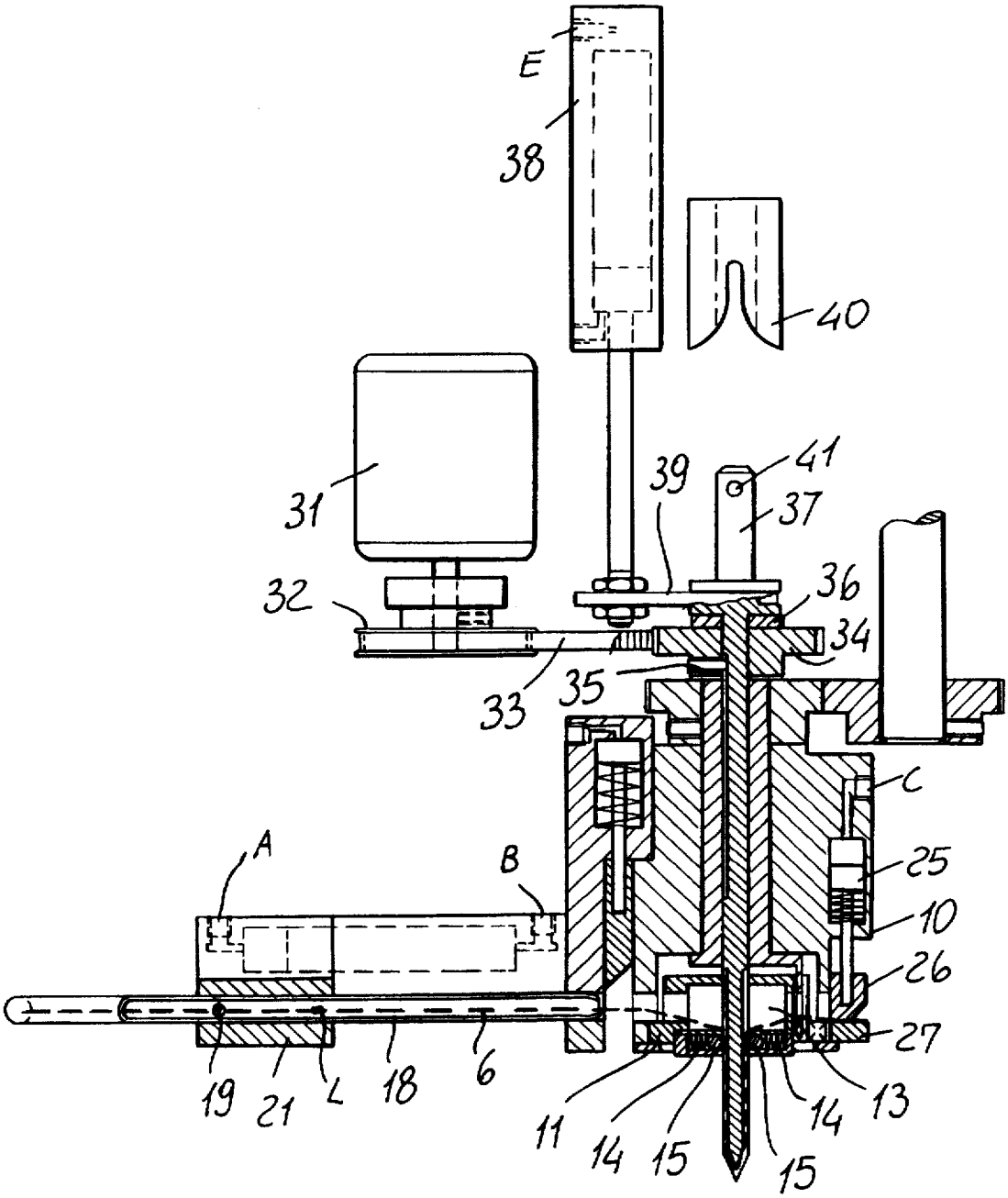

Then, the pressurized air flow to the duct L is stopped and, successively, as shown in FIG. 3, pressurized air is released from the duct A and introduced into the duct B so as to cause the supporting element 21, and accordingly the yarn guiding tube 18, to be withdrawn.

The yarn braking element 19, in cooperation with the loading spring 20, will operate, in this step, in order to restrain the yarn 6 to prevent the latter from sliding off the yarn guiding tube 18 and so as to held said yarn stretched during the engaging of the loading shaft 37 in the inside of the hollow 13.

At this point, pressurized air is supplied into the duct E of the fluid-dynamic cylinder B which, through the connection plate 39, will drive the loading shaft 37 to engage by the tip thereof the yarn 6 and so as to be sandwiched between the two tensioning elements 15 to cause the loading springs 14 to be compressed.

Then, the motor 31 will start to rotate, by consequently driving the toothed pulley 32, the toothed belt 33, toothed pulley 34 which, through the dowel 35 will cause the loading shaft 37 to turn so as to wind on itself a programmed amount of the yarn 6, under the control of the control electronic element.

Figure 4:
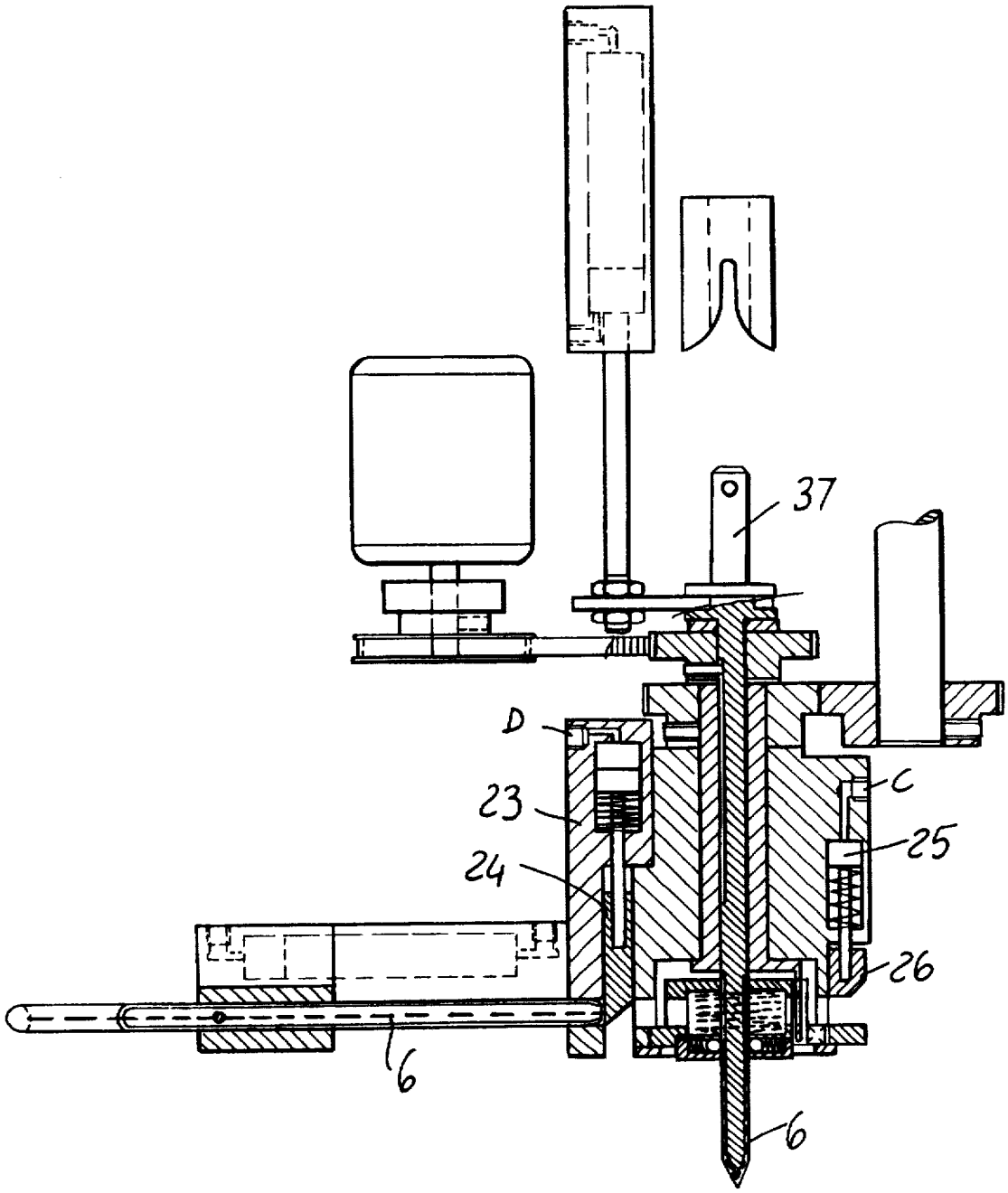

Near the full loading of the yarn 6, during the rotary movement of the loading shaft 37, as is shown in FIG. 4, pressurized air is supplied to the duct D, so as to cause the cylinder 23 piston, on the piston rod of which is engaged the blade 24, to advance so as to cut the yarn 6.

The rotary movement of the loading shaft 37 will continue up to cause the yarn 6 to be fully wound up.

Then, pressurized air is released from the duct C so as to cause the springs of the cylinder 25 to withdraw the piston the piston rod of which is connected to the movable locking element 26, pressurized air being moreover released from the duct D so that the spring of the cylinder 23 will withdraw the cylinder piston on the piston rod of which is coupled the cutting blade 24.

At the end of the loading operation, pressurized air will be released from the duct E of the fluid dynamic cylinder 38, while pressurized air will be supplied to the duct F to cause the piston, on the piston rod of which is connected the coupling plate 39 to withdraw so as to also withdraw the loading element 37, to release or disengage the tensioning elements 15.

The latter will hold, by the loading springs 14, the yarn 6 from the crochet 11 thereby subjecting said yarn to a proper seaming tension.

As the loading shaft 37 is withdrawn, the programmed amount of yarn 6 will be left inside the hollow 13 of the crochet 11.

During its withdrawing movement, the movable guide element 41 keyed on the loading shaft 37 will engage with the fixed guide element 40 which will cause the loading shaft 37 to be returned to its ideal starting conditions.

Figure 5:
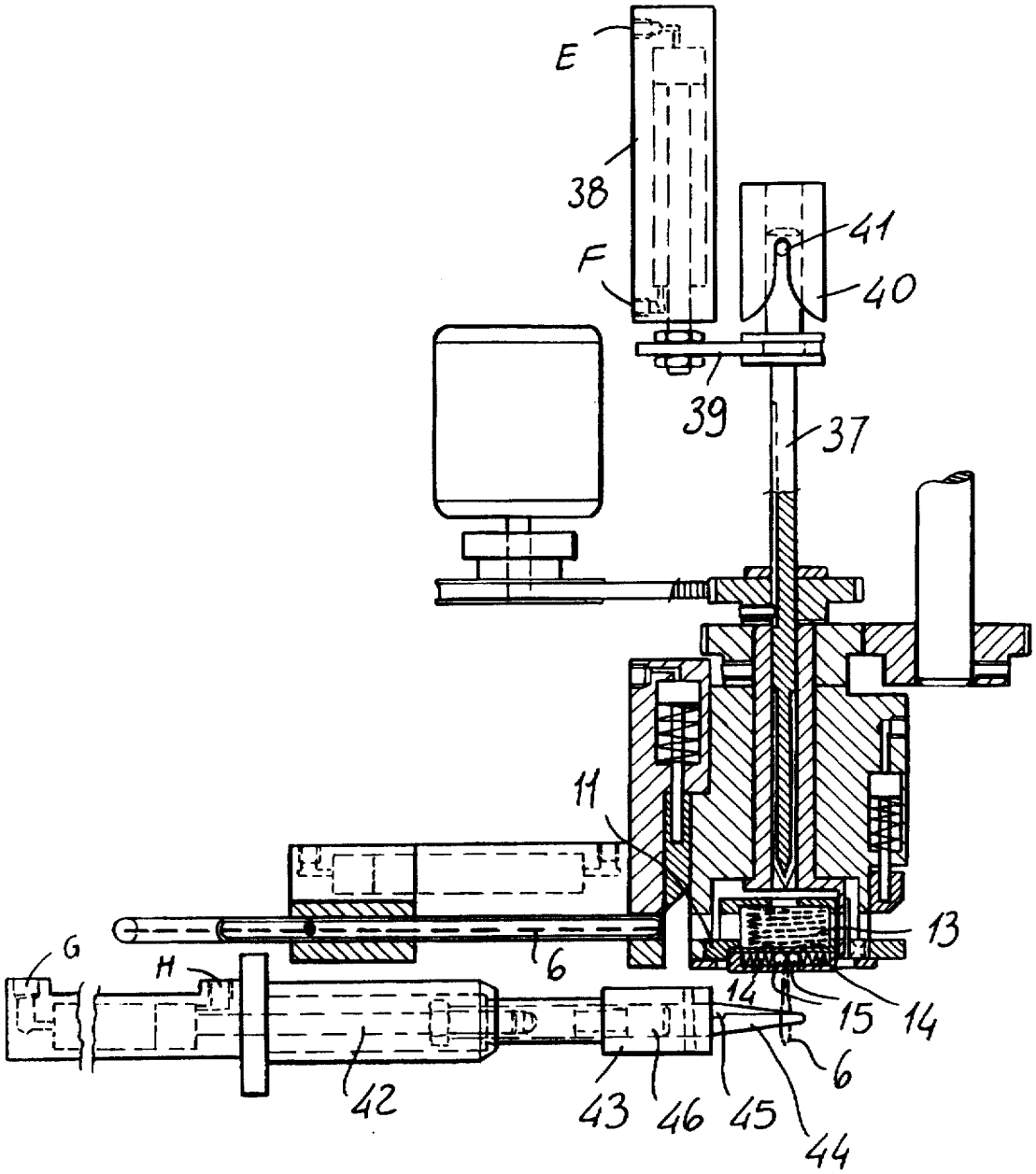

At this time, and as is shown in FIG. 5, pressurized air is again supplied to the duct G of the cylinder 42, on the piston rod of which is affixed the gripper bearing movable element 43, inside of which slides the gripper closing piston 46.

As the gripper closing piston 46 is caused to advance, the two arms 44 and 45 of the gripper will be closed about the yarn 6 exiting the crochet 11.

Thus, the sewing machine will be ready again to start its seaming cycle, without any interventions by the operator.

In this connection it should be apparent that the gears 28 and 29 and shaft 30 will operate to connect the driving shaft 17 and, accordingly, the crochet 11, to a plurality of elements which are kinematically synchronously connected, in a per se known manner, thereby driving said elements so as to properly form the seaming stitches.

After having made some seaming stitches, the gripping means 8 will be disenergized, by releasing pressurized air from the duct G and supplying pressurized air to the duct H thereby causing the gripper holder movable element 43 of the gripper closing piston 46 to withdraw, with a consequent opening of the arms 44 and 45 of the gripper.

At the end of the seaming operation, the operator should recover the small amount of yarn 6 held in the cavity 13 by the crochet 11 by pulling the seamed pieces 3 and 4 without the need of cutting the yarn 6.

Then, the operator will deposit the seamed pieces 3 and 4, and will provide other pieces to be seamed, and, in the meanwhile, the electronic control device will cause the yarn 6 loading cycle to be quickly repeated, so as to load again the yarn 6 into the cavity 13 of the crochet 11, thereby eliminating any dead loading delays as well as cutting delays and with a consequent great saving of yarn 6 which, in conventional sewing machine is on the contrary randomly taken by the operator for forming the first seaming stitches.

Thus, the operator must not take care of the top yarn 6, thereby eliminating any manual operations.

From the above disclosure and from the observations of the figures of the accompanying drawings, it should be apparent that the invention fully achieves the intended aim and objects.

In particular, the fact is to be pointed out that a two-yarn sewing machine has been provided which is specifically designed for automatically loading, cutting, locking and precisely controlling the amount of the top yarn necessary for the seaming operation, without requiring any manual operations, thereby providing a high production yield.

The thus disclosed sewing machine is susceptible to several variations and modifications all of which will come within the scope of the inventive idea.

Moreover, all of the details can be replaced by other technically equivalent elements.

In practicing the invention, the used materials, as well as the contingent size and shapes, can be any, according to requirements.

We claim:

1. A sewing machine, for sewing overlapping materials and making ornamental seams on a surface of a single material, comprising:

a first yarn supplying assembly for supplying a first seaming yarn, under pieces to be seamed, a second yarn supplying assembly for supplying a second seaming yarn above said pieces to be seamed, said second yarn supplying assembly comprising a crochet, a seaming needle arranged above a seaming region, needle driving means for driving said needle by a reciprocating movement along a movement axis thereof, so as to cause a tip of said needle to pass through said pieces to be seamed and engage said first yarn so as to form a yarn loop traversed by said second yarn as a seaming stitch is formed, characterized in that said sewing machine comprises moreover automatic loading means for automatically loading said second yarn in said crochet of said second yarn supplying assembly, and cutting means for cutting said second yarn as an operation of said loading means is ended.

2. A sewing machine, according to claim 1, characterized in that said sewing machine comprises moreover gripping means for gripping said second yarn exiting said crochet during the formation of first seaming stitches.

3. A sewing machine, according to claim 1, characterized in that the automatic loading means for automatically loading the second yarn inside said crochet comprise a yarn guiding tube which is controllably engageable in a throughgoing cross hole, defined through said crochet, gripping means for gripping said yarn arranged on an outlet side of said throughgoing hole and latching means for latching the yarn supplied by said yarn guiding tube inside a hollow defined in said crochet.

4. A sewing machine, according to claim 3, characterized in that said latching means comprise a loading shaft which is controllably engageable in said cavity of said crochet along the rotary axis of said crochet along the rotary axis of said crochet and rotatively driven about a rotary axis thereof in order to wind, in said hollow, a said amount of said yarn supplied by said yarn guiding tube.

5. A sewing machine, according to claim 4, wherein said loading shaft has an end portion thereof projecting from an axial end portion of said crochet, said end portion of said crochet being provided with tensioning elements, driven by loading springs, engageable with the yarn engaged by the end portion of said loading shaft, for holding said yarn as said loading shaft is withdrawing and for adjusting the tension of said second yarn during the seaming operation.

6. A sewing machine, according to claim 3, characterized in that said yarn guiding tube is coupled to pressurized air supplying means for causing said yarn to be driven toward said yarn gripping means.

7. A sewing machine, according to claim 1, characterized in that said cutting means comprise a guillotine blade arranged outside of said crochet and controllably driven in a direction parallel to an axis of said crochet.

8. A sewing machine, according to claim 5, characterized in that said sewing machine comprises a gripper facing an axial and portion of said crochet, provided with said tensioning elements, and controllably engaging a yarn loop left by said end portion of said loading shaft as it is withdrawn into said crochet.

9. A sewing machine, according to claim 1, characterized in that said sewing machine comprises moreover electronic control means controlling said loading shaft, in order to adjust the amount of yarn wound on the loading shaft inside a hollow of said crochet.

* * * * *